United States Patent [19]

Hanson et al.

[11] 4,339,790

[45] Jul. 13, 1982

[54] SEALED PREFOCUSED MOUNT FOR PLASTIC PAR LAMP

[75] Inventors: James M. Hanson, Euclid; Martin J. Graf, Wickliffe; Irving Bradley, Novelty, all of Ohio

[73] Assignee: General Electric Company, Schenectady, N.Y.

[21] Appl. No.: 61,907

[22] Filed: Jul. 30, 1979

[51] Int. Cl.[3] ..... F21V 29/00

[52] U.S. Cl. ..... 362/267; 362/299; 362/306; 362/308; 362/310; 362/329; 362/346; 362/350

[58] Field of Search ..... 313/113, 318; 339/17, 339/125 L, 125 R, 126 R, 122 F; 362/267, 341, 82, 306, 211, 247, 263, 264, 294, 299, 301, 306, 327, 329, 345, 349, 308, 310, 346, 350, 455, 457

[56] References Cited

U.S. PATENT DOCUMENTS

| | | | |
|---|---|---|---|
| 3,314,331 | 4/1967 | Wiley | 313/318 |
| 3,511,982 | 5/1970 | Salter | 339/17 |
| 3,625,796 | 12/1971 | Graves | 362/82 |
| 3,725,698 | 4/1973 | Craig | 313/113 |
| 3,732,415 | 5/1973 | Lindae | 313/318 |
| 3,784,807 | 1/1974 | Boekkooi | 362/267 |
| 3,885,149 | 5/1975 | Wolfe | 313/318 |
| 4,019,045 | 4/1977 | Bassett | 362/267 |
| 4,100,448 | 7/1978 | Chipner | 313/318 |

FOREIGN PATENT DOCUMENTS

| | | | |
|---|---|---|---|
| 2348766 | 4/1975 | Fed. Rep. of Germany | 362/306 |
| 919993 | 2/1963 | United Kingdom | 313/113 |

*Primary Examiner*—Peter A. Nelson

*Attorney, Agent, or Firm*—John F. McDevitt; Philip L. Schlamp; Fred Jacob

[57] ABSTRACT

Improved positioning means are provided to locate a light source at the focus of a parabolic aluminized reflector (PAR) lamp and, in particular to improved positioning means which center said light source in the plastic reflector of a PAR lamp and preferably an all plastic PAR lamp. The preferred mount construction being employed utilizes a plastic block having mating parts which define a cavity from which lead wires extend and which is filled with an elastomeric polymer providing both a leak-proof seal around the lead wires as well as a more reliable barrier to moisture leakage through the mount assembly. The improved positioning means can be rib elements located in the receptacle means on said reflector to which said plastic mount is joined.

3 Claims, 3 Drawing Figures

SEALED PREFOCUSED MOUNT FOR PLASTIC PAR LAMP

RELATED PATENT APPLICATION

U.S. Patent Application Ser. No. 58,061, filed June 16, 1979, in the names of James M. Hanson and Irving Bradley, and assigned to the present assignee, describes a sealed prefocused plastic mount construction for plastic PAR lamps having the same general construction disclosed herein. More particularly, said plastic block mount comprises mating parts which define a cavity for receiving the lead wires of an associated light source and with said cavity being filled with an elastomeric polymer providing a leak-proof enclosure. A further leak-proof seal is provided by the means employed to join said mount construction to the lamp reflector member. Locating or reference surfaces on the mount construction and reflector member cooperate to generally provide accurate positioning of the light source at the focus of said reflector member. Position accuracy of the light source when said prefocused mount is subsequently joined to the reflector can still be a problem, however, due to practical molding tolerances for the associated plastic parts and lead to improper focusing of the light source. Consequently, a more reliable positioning means is desirable to help center the plastic block in the center of the receptacle means on said reflector when being joined thereto.

SUMMARY OF THE INVENTION

It is therefore an important object of the invention to provide improved positioning means for a prefocused mount of a plastic PAR lamp.

Another important object of the invention is to provide improved positioning means for the aforementioned lamp construction requiring only modest structural modification of the now associated parts.

These and other objects of the present invention are achieved by incorporating locating elements in the final mount assembly which positions the light source at the focus of the reflector member. As above indicated, the final mount assembly utilizes raised receptacle means disposed on the rear side of the plastic reflector member to which the plastic block mount is joined. Said locating elements can be ribs extending inwardly from a raised receptacle cavity and which serve to center the plastic block in the center of said cavity. When the plastic block and prefocused light source is fitted into said receptacle cavity for assembly thereto, the rib elements can further serve as a means of joining the assembled parts together as hereinafter explained more explicitly.

In a preferred embodiment, the plastic block being employed as a prefocused mount member comprises mating parts which define the cavity for receiving at least two lead wires and with said mating parts comprising an inner container member defining said cavity which is fitted into an outer housing member. Said inner and outer parts of the mount construction are sealed together after assembly of the lead wires in the cavity by filling said cavity with an elastomeric polymer which provides a leak-proof seal around the lead wires. In said preferred embodiment, the inner container member of the mount assembly has a box-like form which is fitted into an outer box-like housing member and with the box-like members being thereafter sealed together at the periphery of the inner member by ultrasonic or vibration welding. The assembled mount construction having at least said pair of electrical leads extending therefrom can thereafter have the light source assembled to the inleads at a position fixed with respect to a locating surface on the preferred mount construction which prefocuses said light source. The assembled mount and light source can thereafter be fitted to reference features of the raised receptacle molded in the rear outer surface of the reflector member to provide said final mount assembly which positions the light source at the focus of said reflector. The preferred light source of the reflector lamp is a tungsten halogen incandescent lamp such as described in U.S. Pat. No. 4,139,794, which is assigned to the present assignee.

DESCRIPTION OF THE PREFERRED EMBODIMENTS

Figure 1:
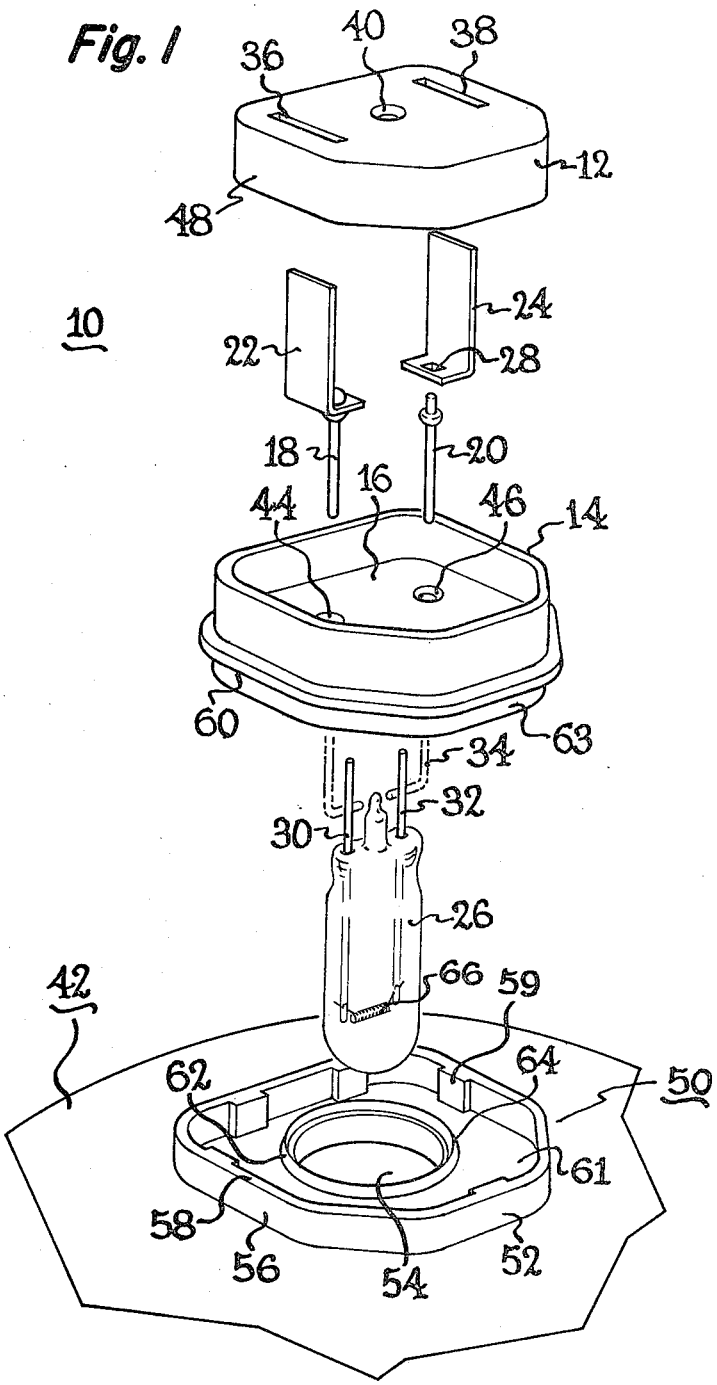
FIG. 1 is a perspective view of a preferred unassembled mount construction according to the present invention which further includes parts of the improved reflector member to which said mount is finally assembled.

Referring to FIG. 1, there is shown the unassembled parts of a prefocused mount and reflector lamp construction of the present invention. Accordingly, said mount construction 10 comprises an assembly of a plastic inner container member 12 which is fitted into an outer plastic housing member 14 to define an enclosed cavity 16 after being sealed together. A pair of lead wires 18 and 20 are joined to metal lug members 22 and 24, respectively, as electrical connecting means extending from opposite ends of the plastic mount construction and which serve to electrically connect the light source 26 to a suitable power supply (not shown). Each of said lead wires is mechanically joined to the L-shaped metal lug member by insertion into a square shaped opening 28 and which is followed by mechanical deformation of the circular lead wire to prevent its rotation thereafter. Said lead wires 18 and 20 can also be joined to lamp inleads 30 and 32, respectively, by conventional crimping or welding preferably after bending 34 to impart added mechanical rigidity. The inner plastic block 12 which defines a cavity for receiving the joined lead wires includes a pair of slotted openings 36 and 38 for exit of the metal lug members along with an entrance opening 40 which permits the cavity to be filled with an elastomeric polymer (not shown) after mating with the outer housing member 14. Sealing means provided in this manner not only provides a leak-proof enclosure from the reflector member 42 after assembly thereto but further provides a leak-proof seal around the lead wires upon filling the channel openings 44 and 46 for said lead wires which lead to the interior of the reflector member. Elastomeric polymer can be injected into the cavity opening after the mating plastic parts have been assembled and preferably bonded together by ultrasonic or vibration welding at the periphery 48 of the inner member. The elastomer thus encapsulates the lugs and leads and, when cured, provides an adhesive seal between all surfaces to achieve the desired leak-proof enclosure.

The assembled mount construction 10 is suitably joined to a reflector member 42 in forming the final mount assembly at raised receptacle means 50 which is disposed on the rear side of said reflector. Accordingly, said receptacle means comprises a generally box-like member 52 into which the assembled plastic block mount is fitted and which contains a central aperture 54 through which the light source 26 extends after joinder. Wall portions 56 of the receptacle means furnish a support ledge 58 which accomodates the underside surface of a flange 60 extending outwardly from the assembled block mount after being joined together as hereinafter described. A plurality of rib elements 59 extend inwardly from the raised receptacle cavity 61 to provide the locating means of the present invention. Specifically, said rib elements 59 center the plastic block 10 in said raised cavity 61 by physical abutment with the lower wall portions 63 of said plastic block. The light source 26 which extends through the central aperture opening 54 and the receptacle cavity 61 is thereby correspondingly centered in a vertical direction with respect to the focus of the reflector member. The remaining alignment of said light source at the focus of said reflector member takes place during assembly of the block mount to the receptacle means as hereinafter explained.

A circular raised wall 62 which terminates in a peak 64 surrounds the central aperture opening 54 in the receptacle cavity 61 and furnishes a means to ultrasonically bond or otherwise adhesively join the assembled block mount to the receptacle means. The above final mount assembly achieves prefocusing of the light source for a reflector lamp in a dual manner for improved alignment of the light source at the focus of said reflector. Specifically, initial prefocusing of said light source is conducted by locating a lamp filament 66 at a predetermined distance from the underside referenced surface or datum plane that is provided by the flange portion 60 of the assembled block mount 10 when said light source is being joined thereto. The final prefocusing of the light source takes place when the assembled block mount and light source is thereafter joined to receptacle means 50 of the reflector member 42. Said final prefocusing step can occur during ultrasonic welding of the assembled block mount and light source unit to the raised wall 62 of the receptacle means as can be better observed by reference to FIG. 2. The ultrasonic weld melts a sufficient portion of the raised wall 62 to enable the underside surface of flange 60 on the assembled block and lamp unit to rest on ledge 58 of the receptacle wall member 52. By such means the ledge 58 serves as a locating surface to establish the portion of the light source at the focus of the reflector. Said final bonding of the circular wall portion 62 to the underside facing surface of the assembled block mount further provides a leak-proof seal for the reflector member against the outside environment. A pair of the centering rib elements 59 is also shown together with the abutting physical contact between said rib elements and the lower wall portion 63 of the plastic block after assembly.

Figure 2:
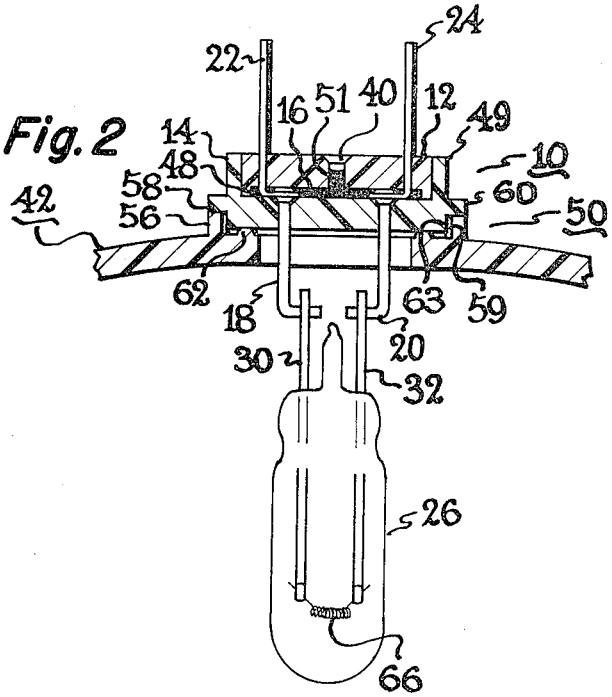
FIG. 2 is a cross sectional view of said mount construction after assembly in the reflector.

In FIG. 2, there is shown a cross section of the final mount assembly described above in connection with FIG. 1. Accordingly, said assembled block mount 10 and light source 26 have been ultrasonically bonded to receptacle means 50 of reflector member 42. As can be noted, the pair of electrical leads 18 and 20 are joined to metal lugs 22 and 24 and reside in the enclosed cavity 16 although extending outwardly from the assembled block mount. Cavity 16 is formed by wall 48 of the inner box-like container member 12 which sits within wall 49 of the outer housing member 14. Aperture opening 40 of said inner container member 12 permits injection of the elastomeric polymer 51 into the enclosed cavity to provide a leak-proof seal for the assembled block mount. As can also be seen, a further leak-proof seal exists between the assembled block mount and the reflector member 42 resulting from joinder therebetween. Ultrasonic welding of the wall 62 in said receptacle means to the underside surface of the assembled block mount provides a barrier to moisture penetration inside the reflector member which can occur from exposure to atmosphere conditions. Said ultrasonic welding of the assembled block mount to receptacle means of reflector member 42 further permits lowering of the underside surface of flange portion 60 of said block mount to rest on the surface 58 provided by outer wall 56 of the receptacle member. A pair of the rib elements 59 in abutment relationship with the lower wall portion 63 of the plastic block is also shown in said cross section view.

Figure 3:
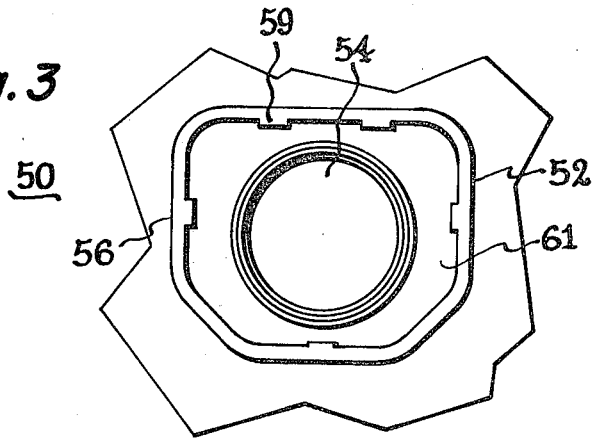
FIG. 3 represents a top view of the raised receptacle means for said reflector member which depicts the locating elements disposed in the receptacle cavity.

A top view of raised receptacle means on the reflector member previously described is shown in FIG. 3 to more clearly depict the location of all rib elements 59 in the receptacle cavity 61 that provides the desired centering of the plastic block mount in a vertical direction when the light source extends through the central aperture 54. Accordingly, said rib elements 59 are distributed in a general equi-spaced manner around the internal periphery of said raised receptacle cavity 61 and can be molded into the wall 56 of the preferred plastic receptacle member 42 when formed. In said preferred all-plastic prefocused mount construction 10, ultrasonic welding can also be used to partially melt the rib elements in abutment with the outer wall 63 of the assembled plastic block and lamp unit to provide adhesive joinder therebetween. Said final welding step takes place after the assembled block mount has been joined to the reflector member as above described.

Suitable elastomeric polymers used in accordance with the present invention include silicone rubber compound such as what is known as RTV or other elastomeric polymers such as polyurethane. The only requirements of the elastomeric polymer is that, when cured, it adheres to the plastic block and the metals used for the leads and lugs, for example nickel-clad iron and brass, respectively, throughout lamp life thus assuring that the seal will be leak-proof. A polycarbonate resin is preferred as the plastic material for the present lamp mount construction by reason of its thermal and mechanical characteristics for this product application.

It will be apparent from the foregoing description to those skilled in the art that various modifications in the present improvement can be made which is still within the spirit and scope of the present invention. For example, as previously noted, a variety of elastomeric polymers may be utilized providing they fulfill the condition that they adhere to both metal and plastic. Similarly, while said preferred embodiments have been described having a generally rectangular shape in the form of box-like members, other suitable shapes such as cylindrical may be used in providing the desired mount construction. Comparable results can also be achieved if the locating rib elements extend outwardly from the plastic block rather than having said positioning means disposed in the receptacle cavity of the reflector member. It also is contemplated that suitable light sources include conventional incandescent lamps, tungsten halogen lamps or discharge lamps. It is intended to limit the present invention, therefore, only by the scope of the following claims.

What we claim as new and desire to secure by Letters Patent of the United States is:

1. An automotive headlamp having a lens directly sealed to a plastic reflector member to provide a leakproof seal using a prefocused light source mount in the form of a sealed plastic block having at least two lead wires extending therefrom, a tungsten halogen lamp joined to the ends of said lead wires, and raised receptacle walls on said reflector member extending rearwardly from the reflector member to which the plastic block is directly sealed to form a final mount assembly which positions the tungsten halogen lamp at the focus of the reflecting surface of said reflector member, the improvement wherein said final mount assembly includes locating elements disposed in said raised receptacle walls to center for the plastic block in the center of the receptacle cavity for engagement during a subsequent bonding operation, said locating elements being joined to wall portions of said plastic block by said bonding operation, thus engaging said block to said reflector member.

2. A reflector lamp as in claim 1 wherein said receptacle means further includes a central opening through which said light source extends for positioning at the focus of the reflecting surface of said reflector, said central opening in said receptacle means having a raised wall portion extending rearwardly from the reflector member.

3. A reflector lamp as in claim 2 wherein an underside surface of the plastic block facing the reflector member is joined to the raised wall portion of the central opening in the receptacle.

* * * * *